US006375600B1

(12) United States Patent
Mallette

(10) Patent No.: US 6,375,600 B1
(45) Date of Patent: Apr. 23, 2002

(54) PORTABLE PUNCHING BALLOON SUPPORT

(76) Inventor: Rejean Mallette, 6371 de l'Aiglon, Laval, (Quebec) (CA), H7L 4W3

( * ) Notice: Subject to any disclaimer, the term of this patent is extended or adjusted under 35 U.S.C. 154(b) by 0 days.

(21) Appl. No.: 09/492,776

(22) Filed: Jan. 28, 2000

Related U.S. Application Data

(60) Provisional application No. 60/118,087, filed on Feb. 1, 1999.

(51) Int. Cl.[7] ..... A63B 69/00

(52) U.S. Cl. ..... 482/86; 482/83; 482/87; 482/90

(58) Field of Search ..... 482/83–90, 27, 482/28

(56) References Cited

U.S. PATENT DOCUMENTS

| | | | | | |
|---|---|---|---|---|---|
| 425,636 | A | * | 4/1890 | Shaw | 482/83 |
| 775,653 | A | * | 11/1904 | Held | 482/83 |
| 3,411,497 | A | * | 11/1968 | Rickey et al. | 482/83 |
| D216,721 | S | * | 3/1970 | Sassenberg | 482/83 |
| 3,510,131 | A | * | 5/1970 | Gardner | 482/87 |
| 4,477,070 | A | * | 10/1984 | Appelbaum | 482/28 |

OTHER PUBLICATIONS

Publication—Summer 1994 A.T.F. Inc.

* cited by examiner

*Primary Examiner*—Jerome W. Donnelly
(74) *Attorney, Agent, or Firm*—Francois Martineau

(57) ABSTRACT

A balloon support system for playing a punching balloon game. This system comprises a movable ground base, a tubular planar arch member defining two upright legs and a top elongated transverse crossbar integral at opposite ends thereof to the upright legs, the bottom ends of the upright legs being anchored to the ground base. A rotatable balloon mount is installed to an intermediate section of the top cross-bar for rotatably carrying a balloon thereon. An elongated pivotal arm member is pivotally mounted at an inner end thereof to the ground base for pivotal movement of the arm member between a first position, generally parallel to the arch member, and a second ground engaging position, extending transversely from the plane of the arch member. A foot support panel member is fixedly mounted to an outer end portion of the pivotal arm member for movement therewith, and includes a foot rest surface. This foot rest surface is adapted to support a user's foot upon the pivotal arm member being in its second position. It is understood that upon the user hitting the balloon for rotation of the latter around the arch member cross-bar, weight loading of the user's foot onto the foot support panel member anchors the support system in position over ground.

6 Claims, 7 Drawing Sheets

56b
58
54b
56
82
70
80
64
66
56a
60
62
72
73
52a
98
52
78
78'
46
46a
54a
54
20
82
70
68
76
76'
72
96
50a
67
38a
38
40a
26c
40
26b
26
22
28b
26a
48
48a
50
28
28a
34
24b
24a
44
94
34a
32
30
42
42'
24
24c
36a
36
100
90
92

54b
58

54
56b
B
70
20
56
96
70
90
34
98
48
48a
36
28
22
38
46a
92
40
46

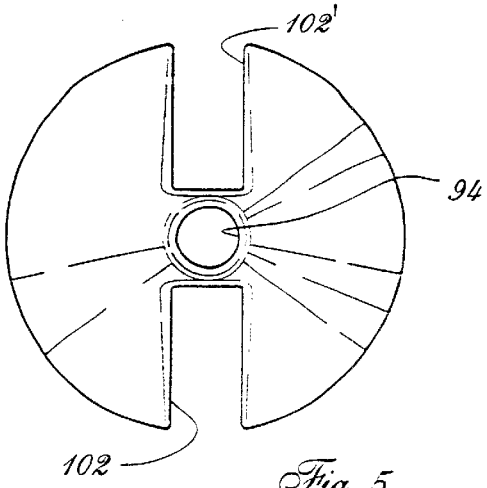
Fig. 5
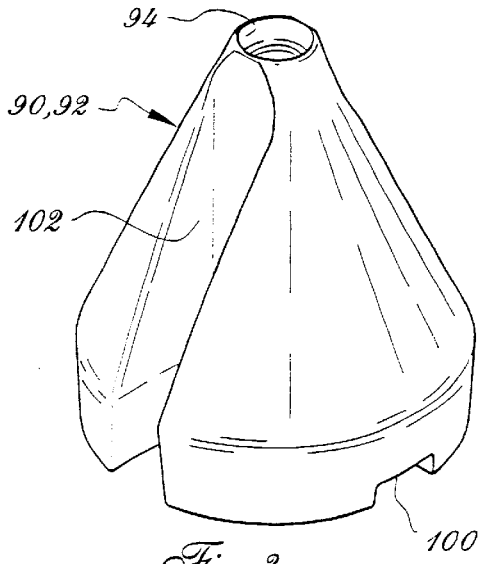
Fig. 3
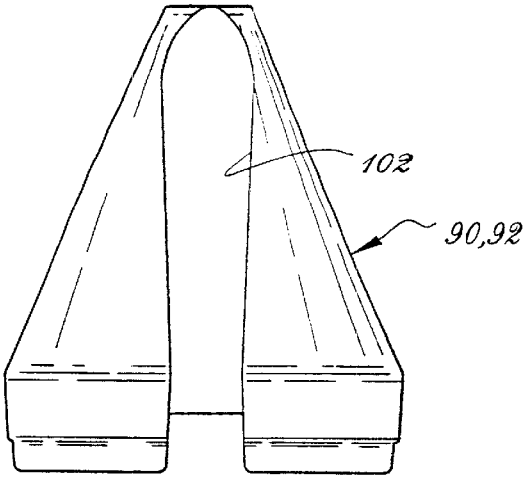
Fig. 7
Fig. 4
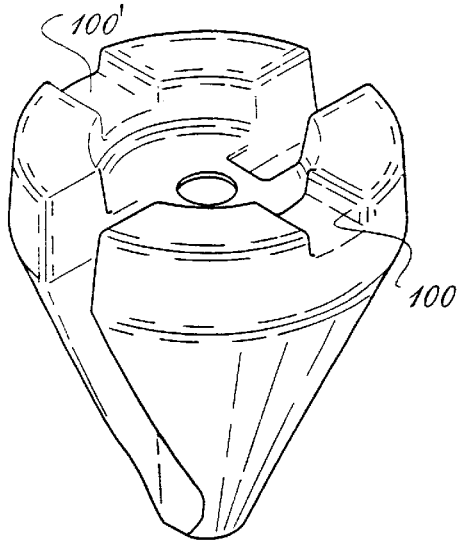
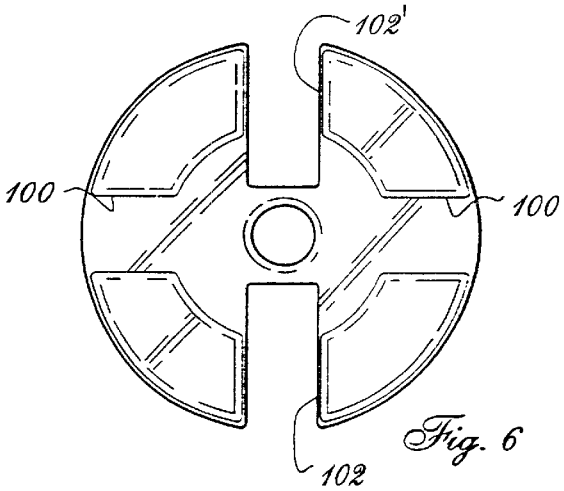
Fig. 6

PORTABLE PUNCHING BALLOON SUPPORT

This application claims benefit of Provisional Appln. 60/118,087 filed Feb. 1, 1999.

FIELD OF THE INVENTION

The present invention relates to a punching balloon game, and more particularly to a portable support for such a game.

BACKGROUND OF THE INVENTION

It is known to provide supports for punching balloon games for outdoor recreation areas, such as public parks and school yards. These punching balloon supports are made from a tubular steel structure, for example cross-sectionally square, rectangular or circular. Such supports comprise a pair of upright, parallel posts that are spacedly and fixedly inserted in the ground in a permanent fashion: they are usually driven into the ground, and are often fixed by means of a concrete base poured around them, for preventing the posts from accidental displacement or theft.

The posts are linked at their upper extremities by a transverse cylindrical crossbar, integrally fixed to the posts. The crossbar is provided near its central portion with an annular ball bearing, welded thereon, that allows a ring attached thereto to rotate around the crossbar.

A punching balloon can be securely and removably attached to the rotatable ring to allow the punching balloon game to be accomplished. Basically, the game is played with two players, and consists of making a balloon rotate around the horizontal rotatable ring.

The punching ball consists of a resistent flexible bag, e.g made of leather, of the air-filled pneumatic type, and having a pear shape. The ball comprises a strap attached to the rotatable ring and initially freely hangs under the crossbar. The game consists in manually hitting the ball tangentially, relative to the cylindrical crossbar, to bring the ball into rotation around the crossbar. A pair of players can play the game, each of the players alternately hitting the ball in tangentially opposite directions until one of them misses the ball. A number of different rules can be applied to offer a variety of games to be played with the punching ball.

The problem with these known devices is that the permanent support required to hold the ball is not available at any desired location. Indeed, only a small number of outdoor public areas are provided with such supports, so that use on the beach or on a camping ground is not possible. Also, the support usually has to be fixedly installed into the ground by pouring concrete around the upright posts, which may discourage the installation thereof, due to the complexity of the operation and to the permanent aspect of the installation. Indoor installation of the support is especially undesirable, since piercing of the floor is necessary to hold the upright posts.

Among the known punching balloon support systems, there exists one embodiment known to the present applicant that has been distributed in Québec market at a very small scale. The trademark or manufacturer's name thereof are not known. In this known balloon support system, the upright post are adjustable in length, so as to enable concurrent adjustment of the height of the top horizontal bar. The ground base consists of a small rectangular steel plate welded to the lower part of each upright post, and having two through bores for engagement therethrough of anchoring screws. The height adjustment of the top horizontal bar is enabled by a set screw engaged into a nut welded in alignment with one bore made in the upper part of the lower upright posts, to enable the tightening of the arch posts. A drawback of such a height adjustment system, is that a number of tools are required to perform the adjustments. However, such known balloon support system is still of the permanent ground anchoring type.

OBJECTS OF THE INVENTION

It is thus the gist of the present invention to provide a portable punching ball support that allows the punching balloon game to be played at any desired location, including indoor locations.

It is an important object of the invention that the support assembly and disassembly be easy to perform by most persons, without requiring specific tools or proficiencies, for easy storage and carrying of the support.

A further object of the invention is to provide such a support, wherein the replacement of worn or damaged parts will be very easy and convenient.

Another object of the invention is that the punching balloon support system can be collapsed in a compact, flattened structure that can facilitate shipping and storage.

SUMMARY OF THE INVENTION

In accordance with the objects of the invention, there is disclosed an improved punching balloon support system, which will increase the appeal of the game and its user-base while eliminating the prior art drawbacks, namely:

- by eliminating the permanent ground anchoring thereof;
- by using the weight of the players at the base of the support to stabilize the support;
- to use state of the art materials which are light and sturdy;
- to be able to use this movable support system both outdoors and indoors;
- to be able to adjust the height of its top balloon supporting horizontal bar, without any tool other than the user's hands;
- to enable easy and compact storage of the support parts within its general structure;
- to facilitate handling and shipping thereof by an adult or children alike;
- to promote a safe use thereof.

More specifically, the invention relates to a balloon support system for playing a punching balloon game, such system comprising: a movable ground base, a tubular planar arch member defining two upright legs and a top-elongated transverse crossbar integral at opposite ends thereof to said upright legs, the bottom ends of said upright legs being anchored to said ground base; a rotatable balloon mount, installed to an intermediate section of said top web for rotatably carrying a balloon thereon; an elongated pivotal arm member, pivotally mounted at an inner end thereof to said ground base for pivotal movement between a first position, generally parallel to said arch member, and a second ground engaging position, extending transversely from the plane of said arch member; and a foot support panel member, fixedly mounted to an outer end portion of said pivotal arm member for movement therewith, and including a foot rest surface, said foot rest surface adapted to support a user's foot upon said pivotal arm member being in its said second position; wherein upon the user hitting the balloon for rotation of the latter around said arch member top web, weight loading of the user's foot onto said foot support panel member anchors the support system in position over ground.

There could be added a second pivotal arm member, pivotally mounted to said ground base between a first position, generally parallel to said arch member but on the side thereof opposite the first mentioned pivotal member in its said first position, and a second ground engaging position, extending transversely from said arch member away in a direction generally opposite the first mentioned pivotal member in the latter said second position; and a corresponding second foot support panel member, fixedly mounted to an outer end portion of said second pivotal arm member for movement therewith, and including a second foot rest surface, said second foot rest surface adapted to support a second user's foot when the second user hits the balloon alternately with the first user for rotation of the latter in alternate directions around said arch member top web; wherein weight loading distribution of the two users' feet onto the two opposite said foot support panel members, stabilizes the support system during the full of the ball punching play.

Preferably, said first and second foot support panel members extend in coplanar fashion with one another in said second position of said first and second pivotal arm members.

It is envisioned to provide a lock member, rotatably mounted to the lower part of at least one of said arch member upright legs and cooperating with said first and second pivotal arm members, said lock member including a seat member wherein said lock member is hand rotatable between an inoperative position, where said seat member clears said first and second pivotal arm members for enabling free pivotal motion of said first and second pivotal arm members, and an operative position, wherein said seat member abuttingly engages said first and second pivotal arm members for locking said first and second pivotal arm members in their said second ground engaging position.

Preferably then, each one of said pivotal arm members consists of an elongated bar with a pivotal mount at its inner end; wherein there are two said lock members. each consisting of a conical base having a diametrally smallest top end and a diametrally largest bottom end and a tubular lengthwise through bore, slidingly engaged by said lower part of corresponding arch member upright leg, said seat member consisting of a notch formed at a peripheral edge section of the diametrally largest lower section of said conical base, and a sector-shape cavity made lengthwisely of said conical base for pivotal engagement therein of said pivotal arm member elongated bar in said first position thereof; whereby said conical base provides a counteracting structure to compensate for moments of force generated at said ground base by the user's fist impacting blows sustained by said balloon and top cross-bar.

Each of said arch member upright legs could include separable lower and upper telescoping parts, and there would then further include: a tubular extension member, interconnecting said lower and upper parts of each arch member upright legs; a length-adjustment member, mounted to the upper section of said arch member lower part and cooperating with said tubular lower extension member and said lower part of said arch member upper part and including an outer hand-rotatable knob, for enabling toolless manual engagement and disengagement of said length-adjustment member releasably interlocking said upper and lower arch member parts and said extension member.

Preferably, said extension members extend downwardly, abuttingly releasably engaging the top ends of the corresponding said conical bases, so as to provide downward bias against said conical bases to bear against said pivotal arm members when the latter occupy their ground engaging positions, to prevent accidental lifting of said pivotal arm members during punching ball play.

BRIEF DESCRIPTION OF THE DRAWING

FIGS. 3 and 4 are upper and lower perspective views respectively of a ground conical base, forming part of the present balloon support, and showing in FIG. 3 the sector shape axial cavity thereof;

FIGS. 5 and 6 are top and bottom end views respectively of the ground conical base of FIGS. 3–4;

FIG. 7 is an elevational view of the ground conical base, showing in edge view the sector-shape axial cavity thereof;

DETAILED DESCRIPTION OF THE PREFERRED EMBODIMENT

Figure 1:
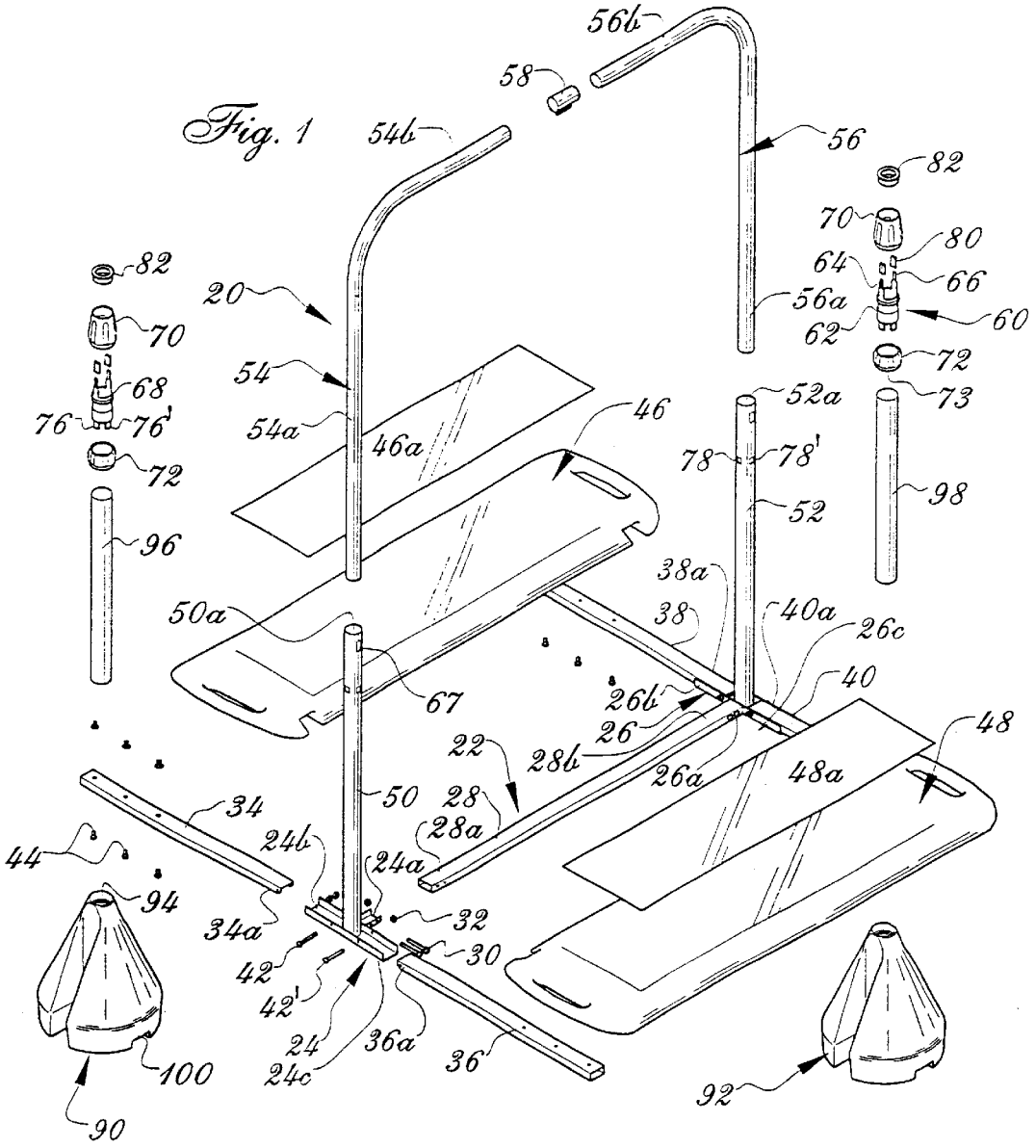
FIG. 1 is an exploded perspective view of the punching balloon support according to the invention.
Figure 2:
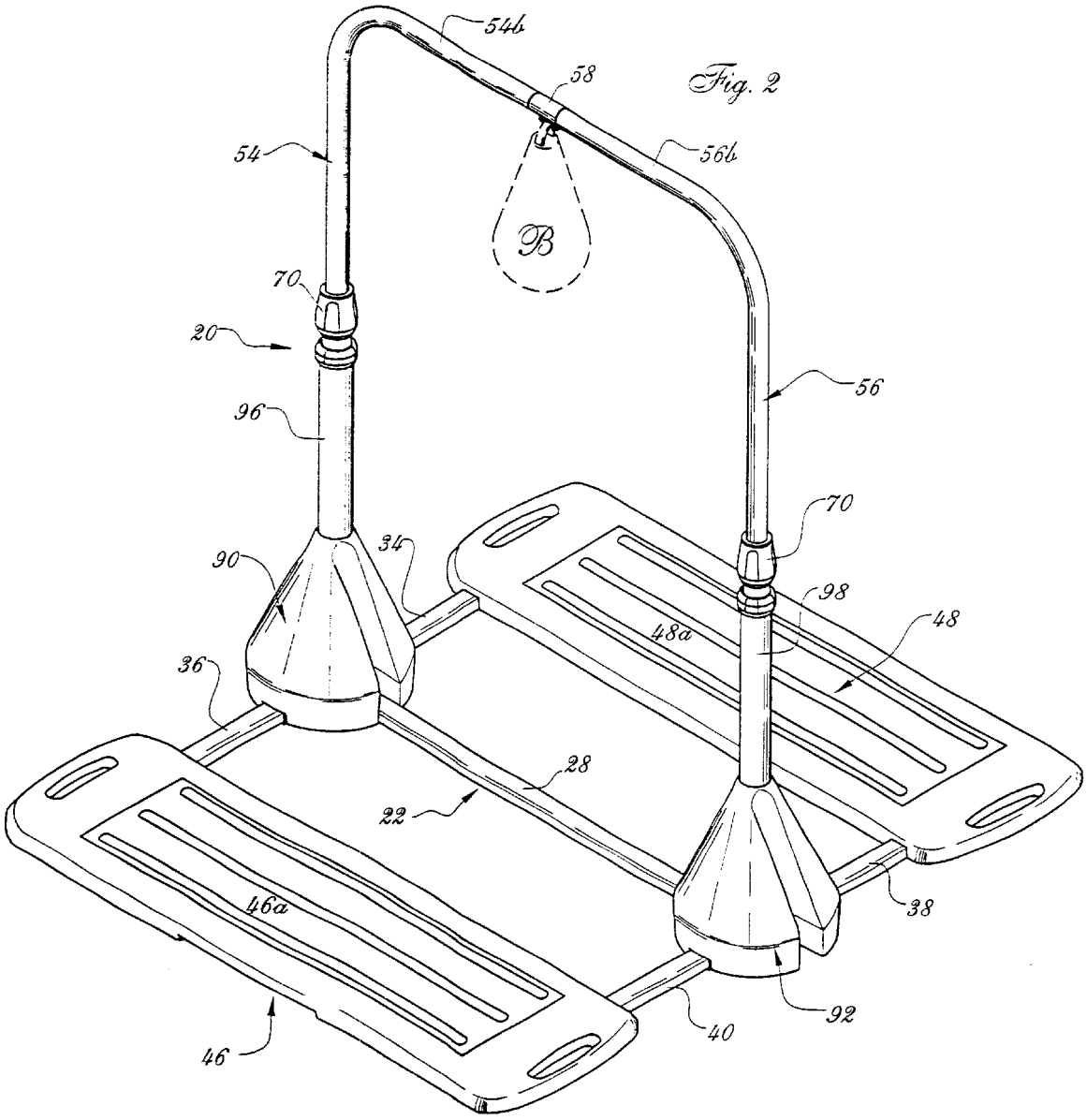
FIG. 2 is a view similar to FIG. 1 but in assembled, non exploded view, with the foot-rest panels being in their operative ground engaging condition, and further showing in dotted lines a punching balloon hanging from the top web cross-bar.
Figure 2A:
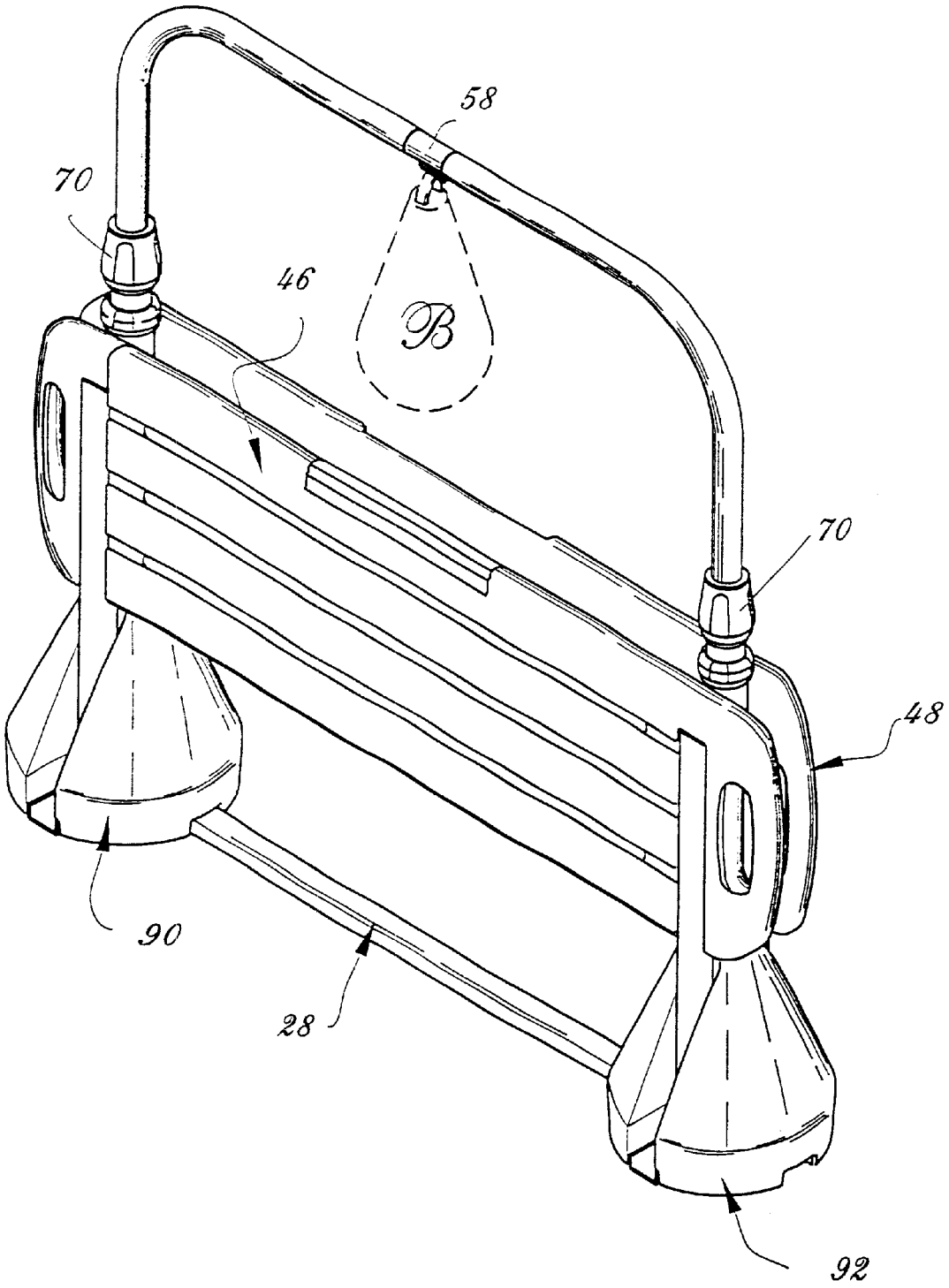
FIG. 2A is similar to FIG. 2, but with the foot-rest panels being raised to their inoperative upright condition.
Figure 9:
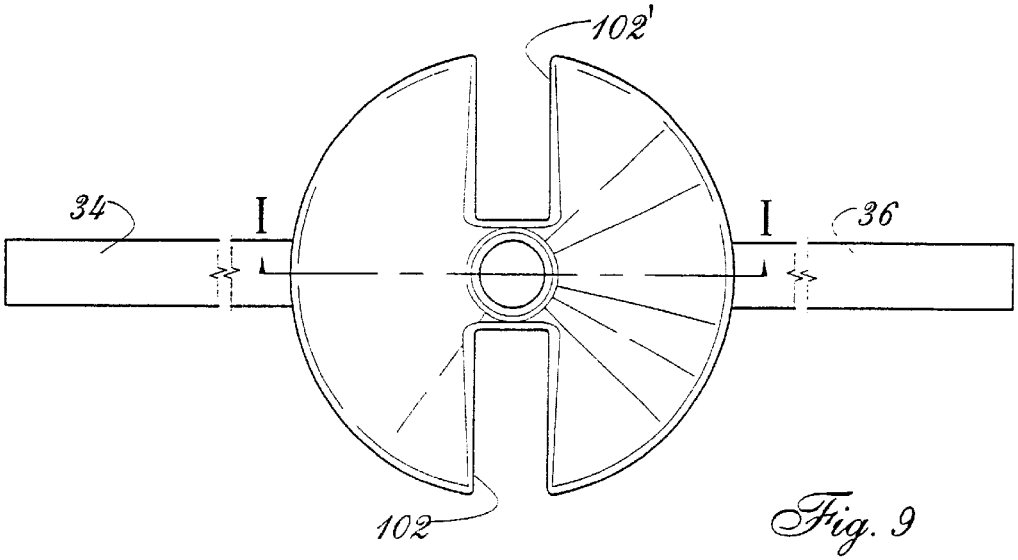
FIG. 9 is a top plan view of the elements of FIG. 8.
Figure 8:
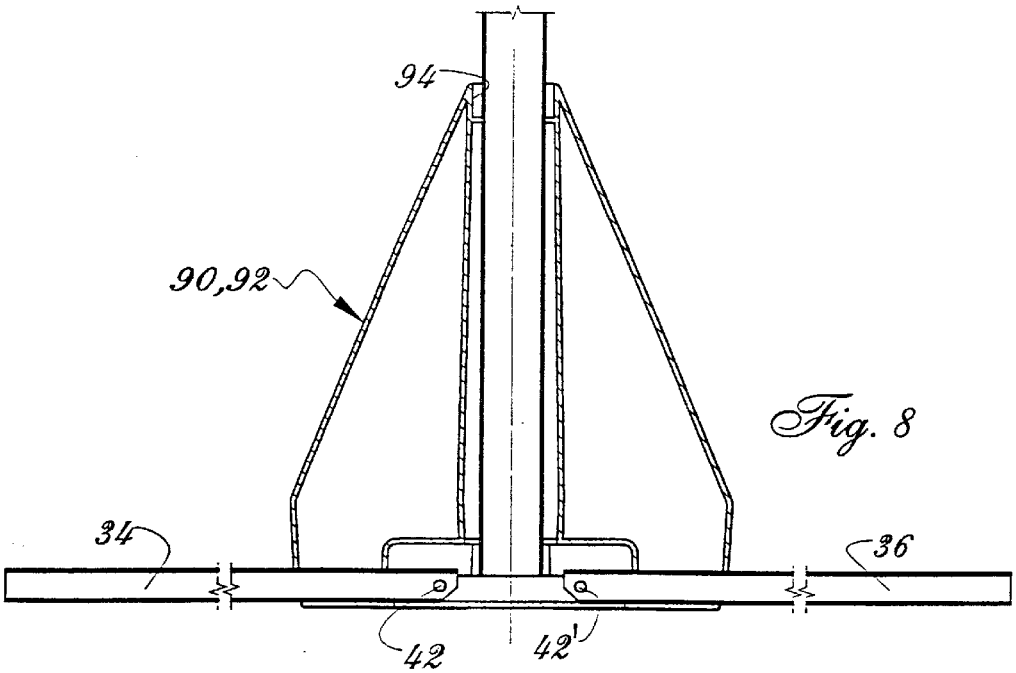
FIG. 8 is a sectional view of the conical base of FIG. 7, but further showing the two foot-rest pivotal arms extended in their operative ground engaging condition.
Figure 11:
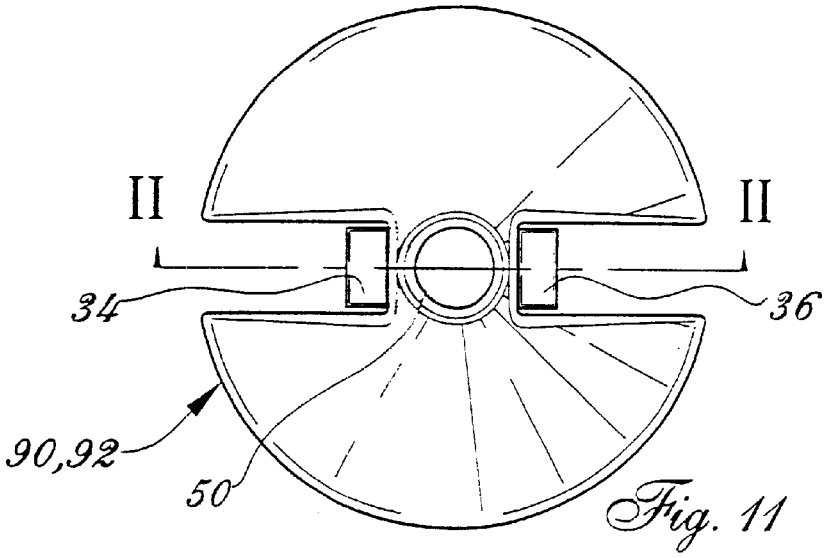
FIG. 11 is a top plan view of the elements of FIG. 10.
Figure 12:
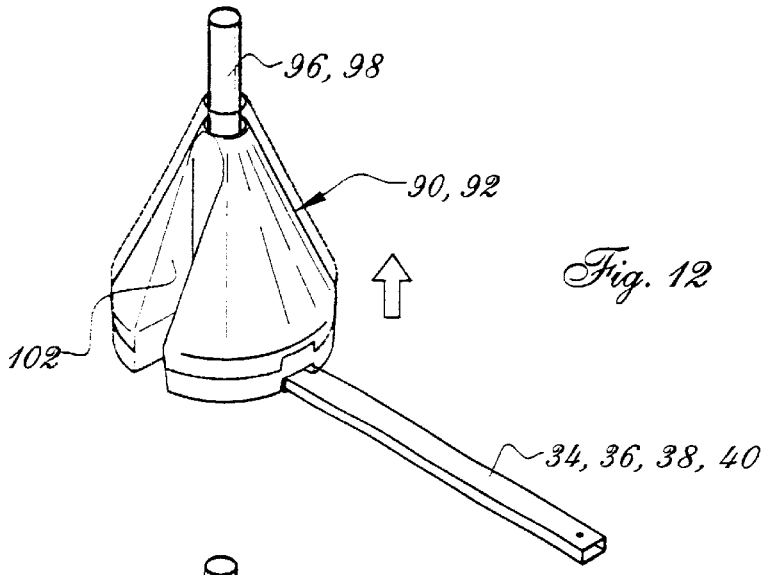
FIG. 12 is a view similar to FIG. 3, but further showing a section of foot-rest panel pivotal arm being engaged into the conical base bottom notch in the ground engaging condition of the foot rest panel.
Figure 13:
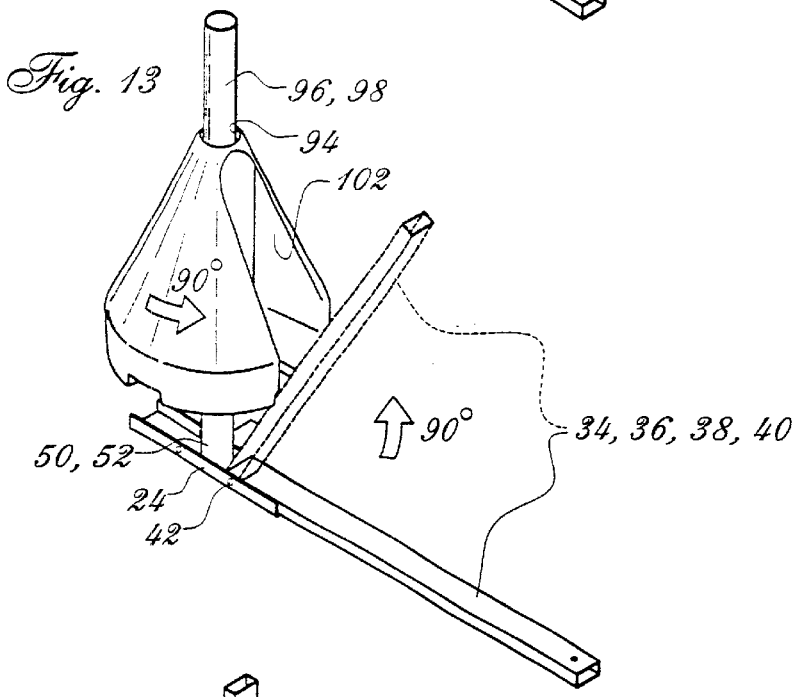
FIG. 13 is a view similar to FIG. 12, but with the conical base being rotated by a quarter of a turn so that the base notch release the ground pivotal arm and the axial sector-shape recess come in register with the foot-rest panel pivotal arm, the latter shown in its ground engaging condition in full lines and in partly raised condition in phantom lines.
Figure 14:
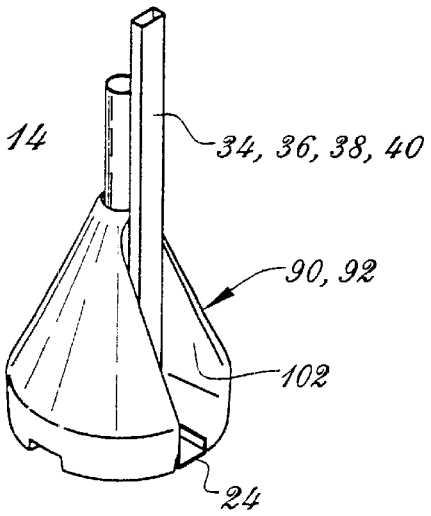
FIG. 14 is a view similar to FIG. 13, but with the foot-rest panel pivotal arm being fully raised into the conical base axial recess in its upright condition.

FIG. 1 shows a punching ball support 20 according to the preferred embodiment of the invention. Support 20 comprises a ground planar base frame 22 being generally H-shape, including two short laterally opposite spaced T-shape rails 24, 26, of U-shape cross-section, engaged in the trough of their transverse legs 24*a*, 26*a*, by the opposite end portions 28*a*, 28*b*, of an elongated ground-engageable bar 28. Bolts and nuts 30, 32, anchor the transverse bar end portions 28*a*, 28*b*, to the two rails legs 24*a*, 26*a*. The inner portions 34*a*, 36*a*, 38*a*, 40*a* of elongated bars 34, 36, 38, 40 fit into the respective troughs of the opposite leg end sections 24*b*, 24*c*, 26*b*, 26*c*, respectively, of the pair of rails 24, 26, for a total of four ground-engageable bars. Bars 34, 36, are thus coaxial to one another; bars 38, 40 are also coaxial to one another; while bars 34, 36 are parallel at all times to bars 38, 40. A screen 42, 42', engages transversely through each corresponding bar inner portion 34*a*, 36*a*, 38, 40*a*, respectively and through the two opposite flanges of the corresponding U-shape rail segments 24*b,* 24*c,* 26*b,* 26*c,* wherein four pivotal mounts 42, 42, 42', 42', are thereby formed for pivotal motion of the four bars 34–40 relative to ground frame 22, from a ground engaging position shown in FIG. 2, to an upright position shown in FIG. 2A and as suggested sequentially in FIGS. 12–14 of the drawings.

To the outer portion of each pair of transversely registering bars 34, 38 and 36, 40, respectively is fixedly secured by rivets a flat ground-engageable rectangular panel 46, 48. Panels 46, 48, are generally rectangular and have a generally flat top foot-rest surface 46*a,* 48*a* Preferably, surfaces 46*a,* 48*a* have antiskid properties, provided e.g. by knurling.

A pair of upright tubular posts 50, 52, project from the center of each rail 24, 26, in between the two opposite bars end portions 34, 36, and 38, 40, respectively. Through the top open mouth 50*a,* 52*a,* of each upright tubular post 50, 52, engages the lower end portion 54*a,* 56*a,* of elbowed tubes 54, 56, respectively, which can be anchored thereto by suitable means, e.g. as disclosed below. The upper end portion 54*b,* 56*b,* of the pair of elbowed tubes 54, 56, are interconnected by a ball-bearing rotatable mount 58, at a distance intermediate the vertical axes of the pair of upright posts 50, 52, so that tube segments 54*b,* 56*b,* be coaxial. The rotatable mount 58 is adapted to fixedly retain a pear-shape punching balloon B, for rotation thereof around the horizontal cross-bar web formed by the two upper end portions 54*b,* 56*b,* of the pair of elbowed tubes 54, 56. The punching balloon B comprises an integral fastening loop strap b attached to mount 58 by melt welding or the like.

Figure 10:
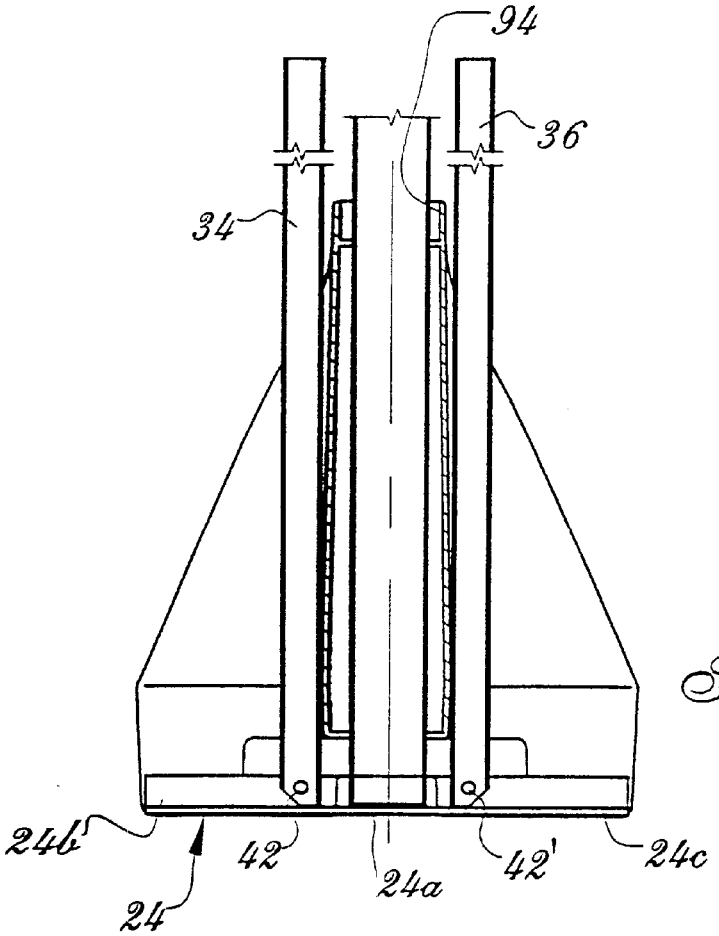
FIG. 10 is a view similar to FIG. 8, but with the pair of foot-rest pivotal arms raised to their inoperative upright condition, for storage or transportation of the full support assembly.

Preferably, a pair of conical bases 90, 92 are mounted around the lower part of each upright post 50, 52, respectively, to act as shock absorbers in compensating for the tangential moment of force generated by the punching ball impacting around top rotatable mount 58. These conical bases 90, 92, include at their diametrally smallest top portions a short cylindroid cavity 94, for receiving and accommodating therein the bottom end portion of a sleeve member 96, 98, respectively. Tubular sleeve members 96, 98, are diametrally larger than upright posts 50, 52, and slidingly surroundingly engage the upper section of posts 50, 52, respectively, above conical bases 90, 92. The bottom radially largest section of the conical bases 90, 92 includes a small cross-sectionally U-shape notch 100, 100' (FIGS. 3–4), complementary in shape to the transverse section of a pivotal bar 34, 36, 38, 40, for engagement therewith in the ground engaging position of the pivotal foot-rest panel 46, 48. The conical bases 90, 92, further include two opposite large sector shape lengthwise recesses, 102, 102', tangentially spaced from the U-notch 100 (100') by a quarter of a turn and complementary in shape to the pivotal bars 34–40, for engagement of the latter therein when the foot-rest panels 46, 48, are raised to their upright condition shown in FIG. 10.

The conical bases 90, 92, by bearing against the ground engaging elongated bars 34–40, operate as a backing so as to spread evenly the loads generated by the rotation of the balloon B being rotatably mounted to the top rotating mount 58.

Preferably, a length adjustment device 60 is provided about the upper end portion of the pair of upright posts 50, 52, for adjusting the height of top horizontal cross-bar 54*b,* 56*b,* 58. Length adjustment device 60 includes a main tightening cylinder 62, having a pair of resilient axial hook fingers 64, 66, and an intermediate outer threading 68. The two main cylinders 62 are designed to engage through the mouth 50*a,* 52*a,* of upright ground pipes 50, 52, respectively, to fit inside of the hollow of the corresponding pipes 50, 52. The tightening cylinder 62 further includes at its bottom portion four peripheral axial hooks 76, 76, 76', 76', which are to releasably engage the complementary bores 78, 78, 78', 78', made at the top portion of the corresponding upright tube 50, 52. These hooks 76, 76', ensure a good spread of the load generated by the tightening of the conical bases 90, 92, via a lower tightening ring 72. To the lower part of this ring 72, one finds a threaded section 73 for the vertical displacement of the lower tightening ring 72 .

Therefore, the fingers 64, 66, at the upper part of the tightening cylinder 62 form lever arms 64, 66, which come in register with the upper bores 67 of the upright posts 50, 52 above bores 78, 78'. Brake shoes 80 are fixedly mounted to the upper part of these lever arms 64, 66. An upper tightening knob 70 is provided, including a conical through bore, for horizontally moving the brake shoes 80 radially inwardly of the upright post 50, 52, to abut against the elbowed tube lower part 54*a,* 56*a,* since the elbowed tube lower upright part has a free vertical movement so as to set the desired height of the horizontal bar 58, or to a closed position for displacement of the support assembly or storage thereof. A cap 82 is engaged into the upper part of the upper ring 70, to provide axial alignment of the elbowed tube lower part 54*a,* 56*a.* with the upright ground post 50, 52, and enable to set the inner play between these two latter tubular elements 50, 54*a,* and 52, 56*a,* respectively, so as to allow free vertical movement of the upper elbowed tube lower part 54*a,* 56*a,* within the hollow of lower upright ground post 50, 52, respectively.

In operation, the ground foot-rest panels 46, 48, are laid down horizontally on the ground. The tightening cylinder 60 is rotated for its resilient finger hooks 64, 66, to engage into the bores 67 of upright post 50, 52. By tightening the lower ring 72, a load is applied onto the bearing sleeve member 96, 98, which surround the upper portion of upright posts 50, 52, above conical bases 90, 92. This load is thus transferred to the bottom conical bases 90, 92, which bears against the ground engaging bars 34–36, 38–40 onto which the foot-rest panels 46, 48, are anchored. This mechanism firmly maintains the bars 34–36, 38–40 in ground engaging condition. The ball players apply a vertical downward force with one or two feet on the panels 46, 48, to maintain the system in equilibrium.

When one wants to position the ground engaging panels 46, 48, in their inoperative ground releasing upright condition, for displacement or storage of the support assembly 20, the first thing to do is to release and lift the bottom conical bases 90, 92, to clear the latter from the underlying pivotal arms 34–40, that support these panels 46, 48. For the bottom conical bases 90, 92, to move upwardly along their associated upright posts 50, 52, one needs to release the pressure applied by the slidable sleeve members 96, 98, that externally surround posts 50, 52; this is done by unscrewing the lower tightening ring 72, and by rotating the conical bases 90, 92, by a quarter of a turn so that their sector-shape cavities 102, 102', come to register with the corresponding foot-rest panel supporting arms 34–40. Similarly, for the two top elbowed tubes 54, 56, to be released from the lower upright posts 50, 52, one needs to unscrew the upper ring 70, whereby the brake shoes 80 are released and thus the upward displacement of the top elbowed tubes 54, 56, outwardly from the top mouths 50*a,* 52*a,* of the lower upright posts 50, 52, is enabled. The detached elbowed tubes 54, 56, and slidable sleeve members 96, 98, may then be taken in sandwich between the pair of pivoted upright foot-rest support panels 46, 48, and these foot-rest support panels 46, 48, may be temporarily attached to one another in such upright, compact condition by a short tie-cord, not illustrated.

In use, the punching ball game can be played in a conventional manner, i.e. by repeatedly hitting the pear-shaped punching ball B tangentially relative to the top crossbar 54*b,* 58, 56*b,* in tangentially opposite directions, so as to bring punching ball into a high-velocity, centrifugally-driven rotation around said top crossbar.

The stability of this support 20 during play is provided by the weight of the players applied on ground-engaging panels 46, 48. Indeed, to hit the ball B, the players need to step on the foot-rest surface 46*a,* 48*a,* of ground-engaging panels 46, 48, and therefore their own weight will effectively prevent the overall support 20 from accidental shuddering or tilting under the sudden and important moment of forces exerted upon it by the players hitting ball B. As suggested in FIG. 2, the foot-rest surfaces 46*a,* 48*a* preferably include an anti-skid (e.g. knurled) contour, to prevent the players from accidentally sliding on ground panels 46, 48.

It can be seen that the support 20 of the invention requires no permanent installation, since it can simply rest on the ground. Thus, it may be temporarily installed at any desired location, outdoor or indoor, and can be easily manually moved to a nearby location by lifting the whole assembled support 20; to this end, either one adult person or two younger children should be able to easily move the support in its assembled state.

Furthermore, the support 20 of the invention is collapsible. It may be disassembled by pulling out the arch member 54, 56, 58, from the upright ground posts 50, 52; and by hingedly pivoting panels 46, 48, upon each other. Thus, in this collapsed position, support can be stored in a carrying box, suitcase, or walk-in closet, for easy storage or carrying thereof.

The support 20 can be manually assembled at another location, for use of the punching ball game at this new location.

It is an important advantage of the present invention that the support 20 be assembled manually, without the use of tools. Furthermore, the simple engagements of the different parts with one another do not require high manual dexterity or specific proficiency for assembling the support. Consequently, even unskilled persons will be able to assemble/disassemble the support themselves The main components of support 20 are made of light weight, resistant materials, such as aluminium or suitable plastic polymers, although a wide variety of alternate suitable materials is also envisioned.

Any modifications to the present invention, which do not deviate from the scope thereof. are considered to be included therein.

For example, any suitable known means for attaching the main components of support 20 with one another are acceptable Also, the ground foot-rest panels 46, 48, are shown to be rectangular, but it is understood that other suitable shapes or configurations (e.g. concavo-convex) would be acceptable, as long as they remain generally flat and offer a sufficient upper surface area for the players to stand thereon. For example, partially pierced wall surfaces could be envisioned, for reducing the weight of the panels.

The telescopic height adjustment of upright tubular segments 50, 52, 96, 98, 54*a,* 56*a,* could be replaced by simple set screws or the like anchoring means, to releasably adjust the height of top cross-bar 54*b,* 56*b,* 58, to bring balloon B at a height selected in accordance with the player's size and height.

I claim:

1. A balloon support system for playing a punching balloon game, such system comprising:

a movable ground base, a tubular planar arch member defining two upright legs and a top-elongated transverse crossbar integral at opposite ends thereof to said upright legs, the bottom ends of said upright legs being anchored to said ground base;

a rotatable balloon mount, installed to an intermediate section of said top elongates transverse crossbar for rotatably carrying a balloon thereon;

an elongated pivotal arm member, pivotally mounted at an inner end thereof to said ground base for pivotal movement between a first position, generally parallel to said arch member, and a second ground engaging position, extending transversely from the plane of said arch member; and a foot support panel member, fixedly mounted to an outer end portion of said pivotal arm member for movement therewith, and including a foot rest surface, said foot rest surface adapted to support a user's foot upon said pivotal arm member being in its said second position;

wherein upon the user hitting the balloon for rotation of the latter around said arch member top web, weight loading of the user's foot onto said foot support panel member anchors the support system in position over ground;

and further including:

a second pivotal arm member, pivotally mounted to said ground base between a first position, generally parallel to said arch member but on the side thereof opposite the first mentioned pivotal member in its said first position, and a second ground engaging position, extending transversely from said arch member away in a direction generally opposite the first mentioned pivotal member in the latter said second position; and a second foot support panel member, fixedly mounted to an outer end portion of said second pivotal arm member for movement therewith, and including a second foot rest surface, said second foot rest surface adapted to support a second user's foot when the second user hits the balloon alternately with the first user for rotation of the latter in alternate directions around said arch member top web;

wherein weight loading distribution of the two users' feet onto the two opposite said foot support panel members, stabilizes the support system during the fill of the ball punching play.

2. A balloon support member as in claim 1, wherein said first and second foot support panel members extend in coplanar fashion with one another in said second position of said first and second pivotal arm members.

3. A balloon support member as in claim 2, further including a lock member, rotatably mounted to the lower part of at least one of said arch member upright legs and cooperating with said first and second pivotal arm members, said lock member including a seat member wherein said lock member is hand rotatable between an inoperative position, where said seat member clears said first and second pivotal arm members for enabling free pivotal motion of said first and second pivotal arm members, and an operative position, wherein said seat member abuttingly engages said first and second pivotal arm members for locking said first and second pivotal arm members in their said second ground engaging position.

4. A balloon support system as in claim 3, wherein each one of said pivotal arm members consists of an elongated bar with a pivotal mount at its inner end;

wherein there are two said lock members each consisting of a conical base having a diametrally smallest top end and a diametrally largest bottom end and a tubular lengthwise through bore, slidingly engaged by said lower part of corresponding arch member upright leg, said seat member consisting of a notch formed at a peripheral edge section of the diametrally largest lower section of said conical base, and a sector-shape cavity made lengthwisely of said conical base for pivotal engagement therein of said pivotal arm member elongated bar in said first position thereof;

whereby said conical base provides a counteracting structure to compensate for moments of force generated at said ground base by the user's fist impacting blows sustained by said balloon and top cross-bar.

5. A balloon support system as in claim 4, wherein each of said arch member upright legs includes separable lower and upper telescoping parts, and further including:

a tubular extension member, interconnecting said lower and upper parts of each arch member upright legs;

a length-adjustment member, mounted to the upper section of said arch member lower part and cooperating with said tubular lower extension member and said lower part of said arch member upper part and including an outer hand-rotatable knob, for enabling toolless manual engagement and disengagement of said length-adjustment member releasably interlocking said upper and lower arch member parts and said extension member.

6. A balloon support system as in claim 5, wherein said extension members extend downwardly, abuttingly releasably engaging the top ends of the corresponding said conical bases, so as to provide downward bias against said conical bases to bear against said pivotal arm members when the latter occupy their ground engaging positions, to prevent accidental lifting of said pivotal arm members during punching ball play.

* * * * *